United States Patent [19]

Anderson

[11] Patent Number: 4,768,576

[45] Date of Patent: Sep. 6, 1988

[54] TILTING TRANSFER MECHANISM FOR A VENETIAN BLIND ASSEMBLY

[75] Inventor: Richard N. Anderson, Owensboro, Ky.

[73] Assignee: Hunter Douglas Inc., Upper Saddle River, N.J.

[21] Appl. No.: 332,812

[22] Filed: Dec. 21, 1981

[51] Int. Cl.[4] ..... E06B 3/32

[52] U.S. Cl. ..... 160/107

[58] Field of Search ..... 160/166-178, 160/107

[56] References Cited

U.S. PATENT DOCUMENTS

| | | |
|---|---|---|
| 2,489,879 | 11/1949 | Grebe . |
| 2,557,978 | 6/1951 | Krumm . |
| 3,022,549 | 2/1962 | Cummings . |
| 3,129,471 | 4/1964 | Johnson et al. . |
| 3,153,819 | 10/1964 | Bond . |
| 3,253,644 | 5/1966 | Gotoh et al. . |
| 3,292,309 | 12/1966 | Horner . |
| 3,605,852 | 9/1971 | Vecchiarelli . |
| 3,703,920 | 11/1972 | Debs . |
| 3,719,221 | 3/1973 | Hanson . |

FOREIGN PATENT DOCUMENTS

| | | |
|---|---|---|
| 1313315 | 11/1962 | France . |
| 2095958 | 2/1972 | France . |
| 204755 | 3/1966 | Sweden . |
| 940466 | 10/1963 | United Kingdom . |
| 1193333 | 5/1970 | United Kingdom . |

*Primary Examiner*—Ramon S. Britts
*Assistant Examiner*—David M. Purol
*Attorney, Agent, or Firm*—Pennie & Edmonds

[57] ABSTRACT

A tilting transfer mechanism for a venetian blind assembly particularly for use behind glazing where the blind assembly includes a tape cable forming part of a supporting means supporting a plurality of slats. The tape cable is supported by a pivotal tape stabilization means which in turn is operatively connected to a linearly movable operating element by a connecting means. The operating element in turn is coupled to an operating member.

23 Claims, 8 Drawing Sheets

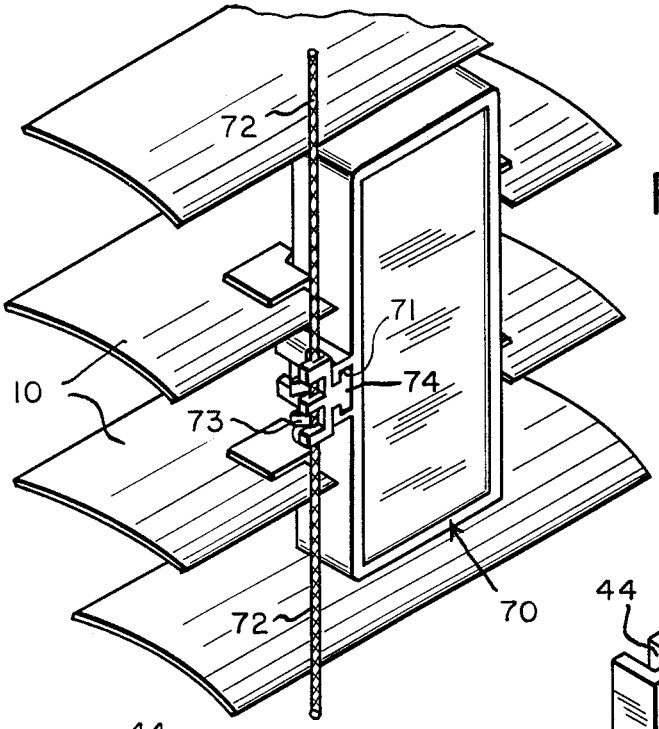
FIG. 7
FIG. 6
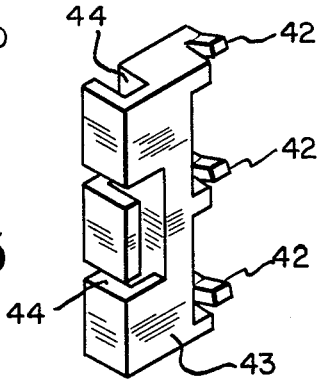
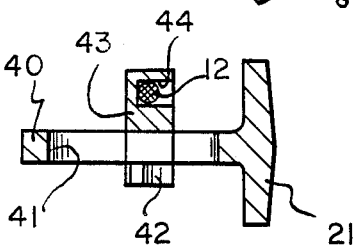
FIG. 5
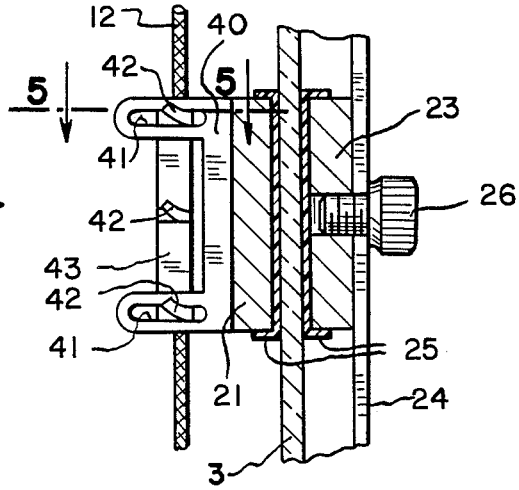
FIG. 4

TILTING TRANSFER MECHANISM FOR A VENETIAN BLIND ASSEMBLY

TECHNICAL FIELD

The invention relates to a tilting transfer mechanism for a venetian blind assembly and particularly to a venetian blind assembly adapted to be positioned behind glazing, as for example between two panes of glass.

REFERENCE TO OTHER APPLICATIONS

The application relates to subject matter disclosed in application Ser. No. 193,651, filed Oct. 3, 1980, now abandoned.

BACKGROUND ART

Venetian blind assemblies have been proposed for use in window units where the blind assembly is positioned behind glazing any number of different ways. For example, the blind assembly may be adjacent a single pane of glass, may be positioned between two panes, or even positioned in a triple pane window unit. In those units having two or more panes, blind assemblies may in addition be sealed with respect to the panes such that the unit forms a hermetically sealed window unit to provide superior insulation properties. In all forms of units, including single and multiple pane constructions and unsealed and hermetically sealed constructions, it is desirable to have a single effective tilting control mechanism by which the tilt of individual slats of the blind assembly may be easily and accurately regulated using a minimum of force and where the degree of force necessary to tilt the slats remains substantially uniform during the complete range of tilting.

It is also desirable in venetian blind assemblies in order to facilitate placement in a window unit that the blind assembly be fully reversible in a window opening, that is to say, that the top and bottom ends of the blind be reversible in the unit or that the top and bottom ends of the unit be reversible. This reversible feature in turn requires a tilting transfer mechanism which may work equally as well in one position of the blind assembly or window unit as in a reverse position.

Further it is desirable in window units having two or more spaced panes that the slats of the blind assembly in the open position occupy as much of the space between the panes as possible in order to reduce expense of blind assembly and to reduce operating forces. If smaller width slats are utilized where the width of the slat is substantially less than the space between panes, more slats will be required to completely close the window opening thus increasing expense of manufacture and assembly as well as forces necessary to operate the tilting mechanism.

A problem with many hermetically sealed units in particular has been the difficulty of providing controls exterior of the window unit by which the tilting of slats of the blind assembly within the unit may be regulated while at the same time preserving the integrity of the sealed unit. Controls extending through the framing forming the unit wear after use increasing the difficulty of maintaining the sealing of the unit.

Magnetic couplings have been proposed for hermetically sealed window units to connect an operating member exterior of the unit to a blind operating element on the interior of the unit. See for example U.S. Pat. Nos. 3,022,549 dated Feb. 27, 1962 and 3,129,471 dated Apr. 21, 1964. A problem with such magnetic couplings to date has been to design one which is small in size and which will at the same time have sufficient coupling strength to enable the slats of the blind to be tilted throughout their complete operating range.

It is therefore an object of my invention to provide for a venetian blind tilting transfer mechanism in which the force necessary to operate the mechanism remains substantially constant throughout the complete range of operation and which is adaptable for use with venetian blind assemblies having large width slats as well as narrow width slats.

It is a further object of my invention to provide a tilting transfer mechanism which is applicable for use with a blind assembly that may be reversed in a window unit or where the unit may be reversed in a window opening or even where the blind or unit may be installed at an angle to the vertical axis.

A further object of the invention is to provide for a tilting transfer mechanism having a minimum of parts and which utilizes conventional blind assembly structure, as for example, a tape cable for transferring tilting forces to the slats of the blind assembly.

It is a further object of my invention to provide for a magnetic coupling connecting exterior controls with interior operating elements of a tilting transfer mechanism of a venetian blind assembly positioned in a hermetically sealed window unit where the coupling is small in size and does not interfere with the movement of the slats.

GENERAL DESCRIPTION OF THE INVENTION

Broadly a tilting transfer mechanism constructed according to my invention is adapted for use in a venetian blind assembly having a plurality of slats, at least one tape cable forming part of a supporting means supporting the slats and where the tape cable is supported by upper and lower slat stabilizing elements. The stabilizing elements are pivotally supported by bearing elements such that pivotal movement of the stabilizing elements results in vertical movement of the tape cable and subsequent tilting of the slats. A connecting means operatively connects a linearly movable operating element with the stabilizing elements in order to move the same about the bearings.

The connecting means may take a number of forms but it is desirable in all forms that longitudinal forces in the connecting means extending between the operating element and the slat stabilizing elements and parallel to the linear movement of the operating element remain substantially the same throughout movement of the operating element and that lateral forces be kept to a minimum. This is accomplished one way by using flexible or rigid pivotal linear elements connecting the operating element to a tape cable rather than having the tape cable connected directly to the operating element. This construction accommodates lateral movement of the tape cable towards and away from the operating element as the stabilizing elements pivot about their bearings and reduces any stretch of the tape cable and resultant variation in forces necessary to pivot the tape cable stabilizing elements.

A further way of accommodating lateral movement of the tape cable caused by the pivoting of the stabilizing elements is to provide one or more guides on a rigid member mounted on the operating element with the guides extending perpendicular to the direction of linear movement of the element. Hooks or slidable elements mounted on the tape cable then engage the slots or guides with hooks or slidable elements free to slide in the slots or guides as the cable moves laterally when the stabilizing elements are pivoted.

Preferably the operating element according to the invention is magnetically coupled with a linear movable operating member. Both the operating element and member have housings each containing at least one magnet with the housings free to slide on opposite sides of a glass pane forming part of a window unit. A magnetically pervious material having lubricant properties may be positioned between the magnets and the glass pane to reduce the operating force necessary to move the operating member. To further improve operating characteristics, a slide may be fixed to the window unit to provide a guide for the housing of the operating member.

The housing of the operating element is connected to a tape cable at its upper and lower ends at tie points or by way of a groove extending along the back of the housing into which a portion of the tape cable is wedged. Cutouts are included in those slats adjacent the housing of the operating element in the area of the tape cable to accommodate the housing as it moves linearly and so as to not interfer with the housing as the slats are tilted. Since the cutouts in the slats are adjacent a tape cable, provision may be made to support the slats at these points to prevent longitudinal displacement of the slats relative to the cables. This can be accomplished by having pads on the slats to connect upper and lower rungs of a tape ladder to the upper and lower surface of the slats or a further tape ladder may be used to connect the slats with cutouts to other solid slats without cutouts.

The connecting means, instead of operatively connecting the slat stabilizing elements to the operating element by way of the tape cable, may operatively connect the two together by way of a separate drive cable. In this instance, the drive cable engages a surface of a stabilizing element spaced from the pivot axis and the cable is guided by means of a guide arm in a direction parallel to the linear movement of the operating element. In this manner, the forces in the drive cable remain substantially constant on both sides of the operating member thus maintaining uniform appearance of the slats in the blind assembly.

BRIEF DESCRIPTION OF THE DRAWINGS

FIG. 4 is a cross-sectional view of a third embodiment of a connection between a tape cable and an operating element;

FIG. 5 is a cross-sectional view of the connection of FIG. 4 taken along lines 5—5;

FIG. 6 is a perspective view of the securing means of FIG. 4 securing hooks to a tape cable;

FIG. 7 is a cross-sectional view of an operating element in the form of a housing enclosing magnets connected to a tape cable and illustrates a further embodiment of connection of a tape cable with an operating member;

BEST MODES FOR CARRYING OUT THE INVENTION

Figure 1:
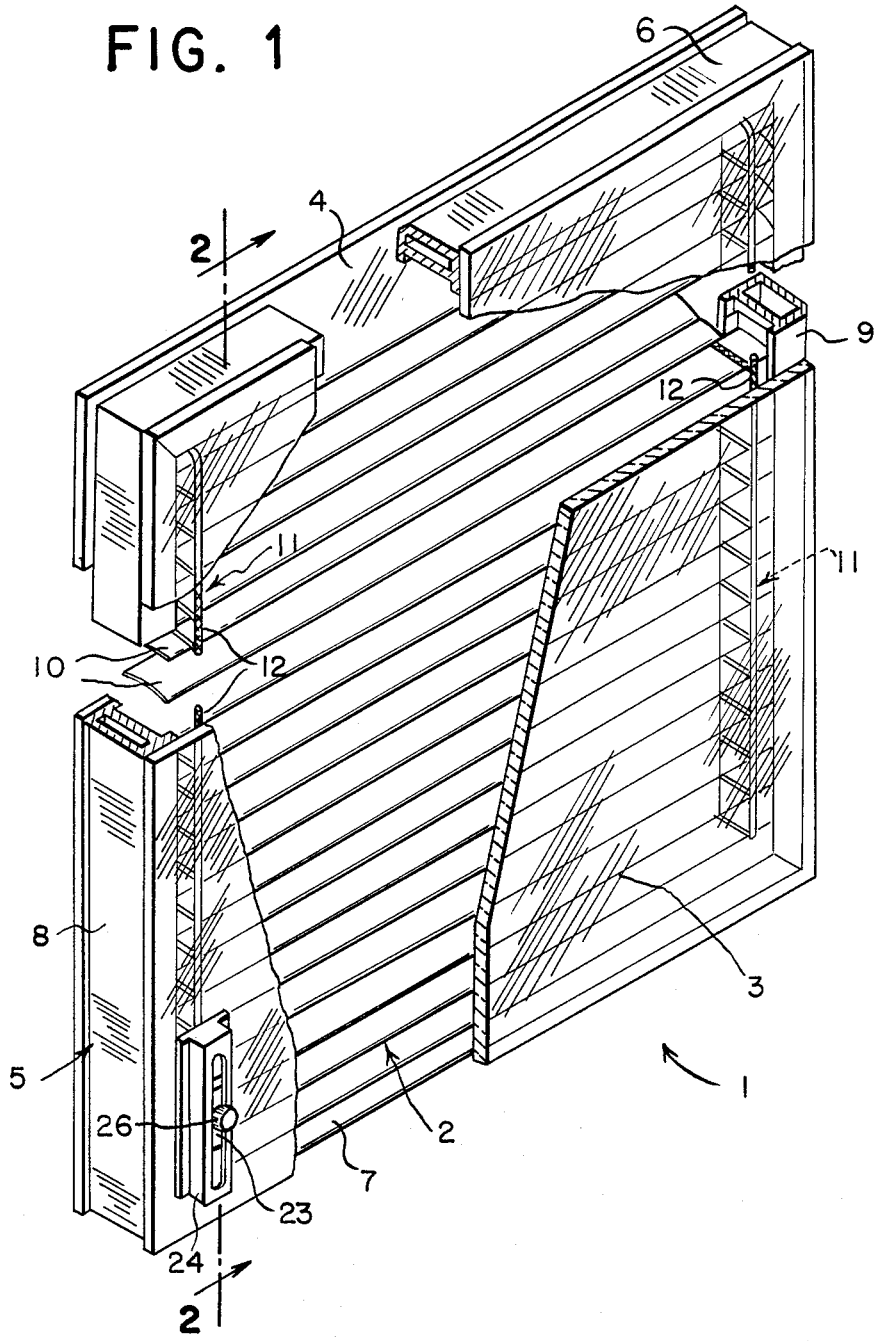
FIG. 1 is a broken perspective view of a window unit constructed according to the invention having a venetian blind assembly therein.
Figure 2:
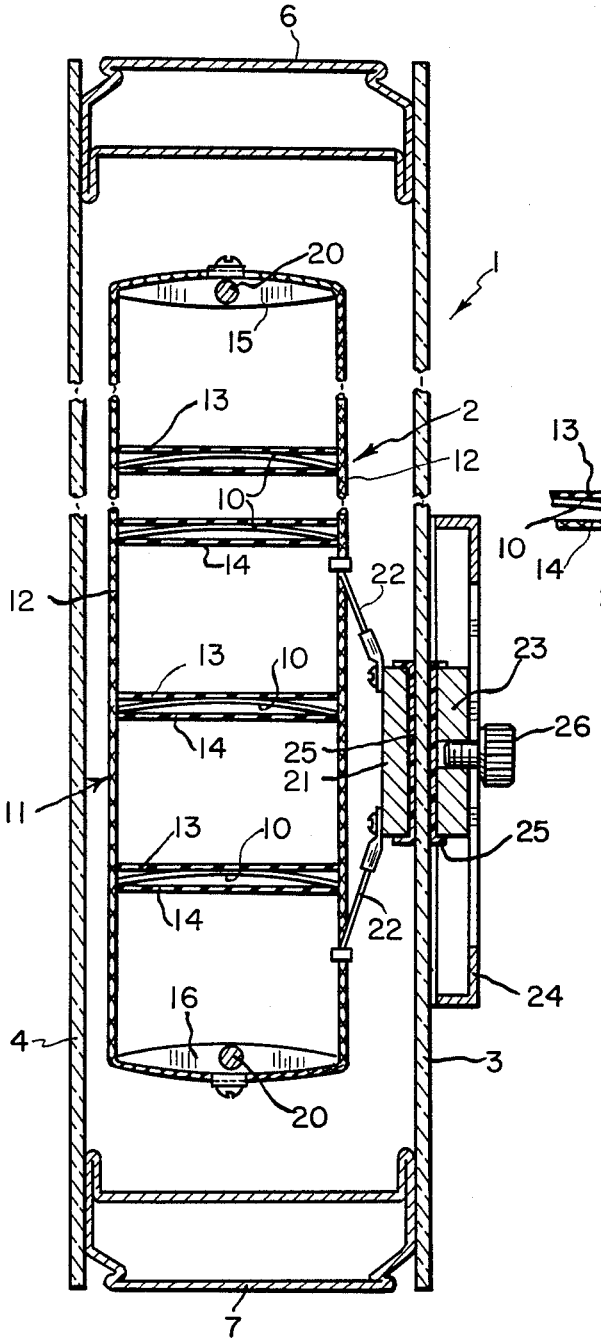
FIG. 2 is a cross-sectional view of the window unit of FIG. 1 taken along lines 2—2 illustrating one embodiment of a connection between a tape cable and an operating element.

Referring to FIGS. 1 and 2 there is illustrated a window unit 1 comprising a venetian blind assembly 2 positioned between a front pane of glass 3 and a rear pane of glass 4. The panes 3 and 4 may be sealed with respect to a frame 5 comprising horizontally upper and lower member 6 and 7 respectively and vertical extending side members 8 and 9 to form a hermetically sealed window unit.

The venetian blind assembly 2 comprises a plurality of slats 10 contained within two tape ladders 11. Each tape ladder 11 comprises two tape cables 12 having a plurality of upper rungs 13 and lower rungs 14 extending therebetween with the slats 10 being supported between upper and lower rungs. The tape cables 12 are supported and stabilized by an upper stabilizing element 15 and a lower stabilizing element 16 each of which is mounted on a pivotal bearing element 20.

As shown in FIG. 2, a tape cable 12 is joined to an operating element 21 by means of flexible linear elements 22 with one linear element being connected to the top of the operating element and the other linear element to the bottom of the operating element. While elements 22 are shown as being flexible linear elements, they could in the alternative comprise rigid linear elements pivotally connected to the cable 12 and operating element 21. Operating element 21 is linearly movable in a vertical direction on the glass pane 3 and is magnetically coupled with an operating member 23 linearly movable in a slide 24 fixed with respect to the pane.

As seen by reference to FIG. 2, if the operating element is moved up or down from the position shown, the stabilizing elements 15 and 16 will be caused to move about their pivots 20 to regulate the opening between the slats 10. Rotation of the stabilizing elements from the position shown will move the edges of the elements and consequently the tape cable 12 away from both panes 3 and 4. If the connection between the cable 12 and the operating element 21 were rigid and not pivotally connected at its ends, cable 12 would be stretched to move laterally with respect to the axis of bearing element 20 thus imparting a lateral force into the tilting transfer mechanism. This would in turn result in increased side loads on the bearing elements 20 and so increase friction losses and increase forces necessary to pivot the stabilizing elements. The use of flexible linear elements 22, or rigid elements pivotally connected at their ends, provides a flexible connection between the operating element and the tape cable with respect to the operating element when the stabilizing elements pivot thus substantially reducing lateral forces applied to the tilting transfer system.

The operating element 21 and operating member 23 preferably are provided with teflon covers 25 or other material having similar lubricating properties to reduce friction forces between the glass surface and the element and member. In addition the operating member may be provided with an operating knob 26 which may be grasped in order to move the member within the slide 24. The knob in addition is preferably threaded into the operating member so that the knob and operating member may be locked into place by screwing the knob down so that it tightly engages the slide.

Figure 3:
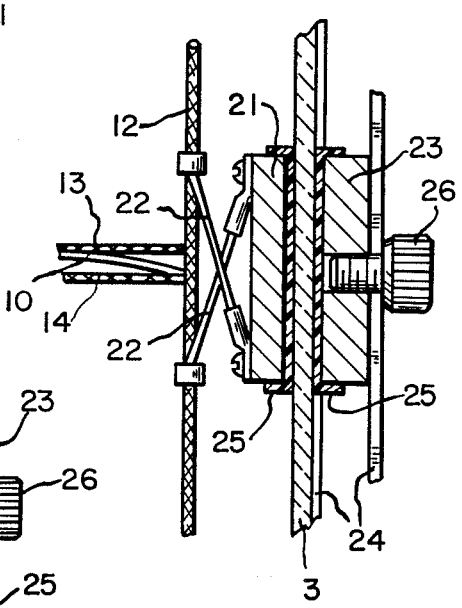
FIG. 3 is a cross-sectional view of a second embodiment of a connection between a tape cable and an operating element.

In some instances because of space limitations or aesthetic purposes, it may be desirable to have the linear members completely covered by the operating element. This can be done as shown in FIG. 3 by having the linear elements cross in a vertical plane. The effective length of each element remains the same as for the arrangement shown in FIG. 2.

While a tape cable connected to upper and lower rungs is shown in FIGS. 1–3 to form a tape ladder, the tilting transfer mechanism shown could be utilized equally as well with tape cables which are connected to individual slats by other means. For example, small clips may be used to connect a cable directly to a slat or the cable may be provided with eyelets that connect with holes in the slats.

A further form of connection between a tape cable and operating member is shown in FIGS. 4–6 in which like parts illustrated in other drawings have the same identifying numerals. The operating element 21 as shown has a rigid member 40 including laterally extending slots or guides 41 which engage hooks or slidable elements 42 carried on a securing means or connector 43 in turn joined to the cable 12 by extending the cable through grooves 44. As is apparent from FIGS. 4 and 5, the cable 12 and securing means 43 are free to move in a transverse direction with respect to the linear movement of operating member 21 so that lateral loads will not be imparted into the system when the slats are tilted.

A still further connection between an operating member and a cable is shown in FIG. 7. There the operating member 70 comprising a housing includes a guide means 71 on the housing extending in a direction transverse to the linear vertical movement of the operating member. The cable 72 which is connected to stabilizing elements, not shown, has a connector piece 73 joined thereto where the connector piece includes a slidable element 74 slidable in guide 71. The cable 72 and connector piece are thus free to move in a transverse direction with respect to the linear movement of the operating member 70 in the same manner as with the forms of connecting means as shown in FIGS. 2–6 thus assuring no lateral loads being introduced when the slats are tilted.

Figure 8:
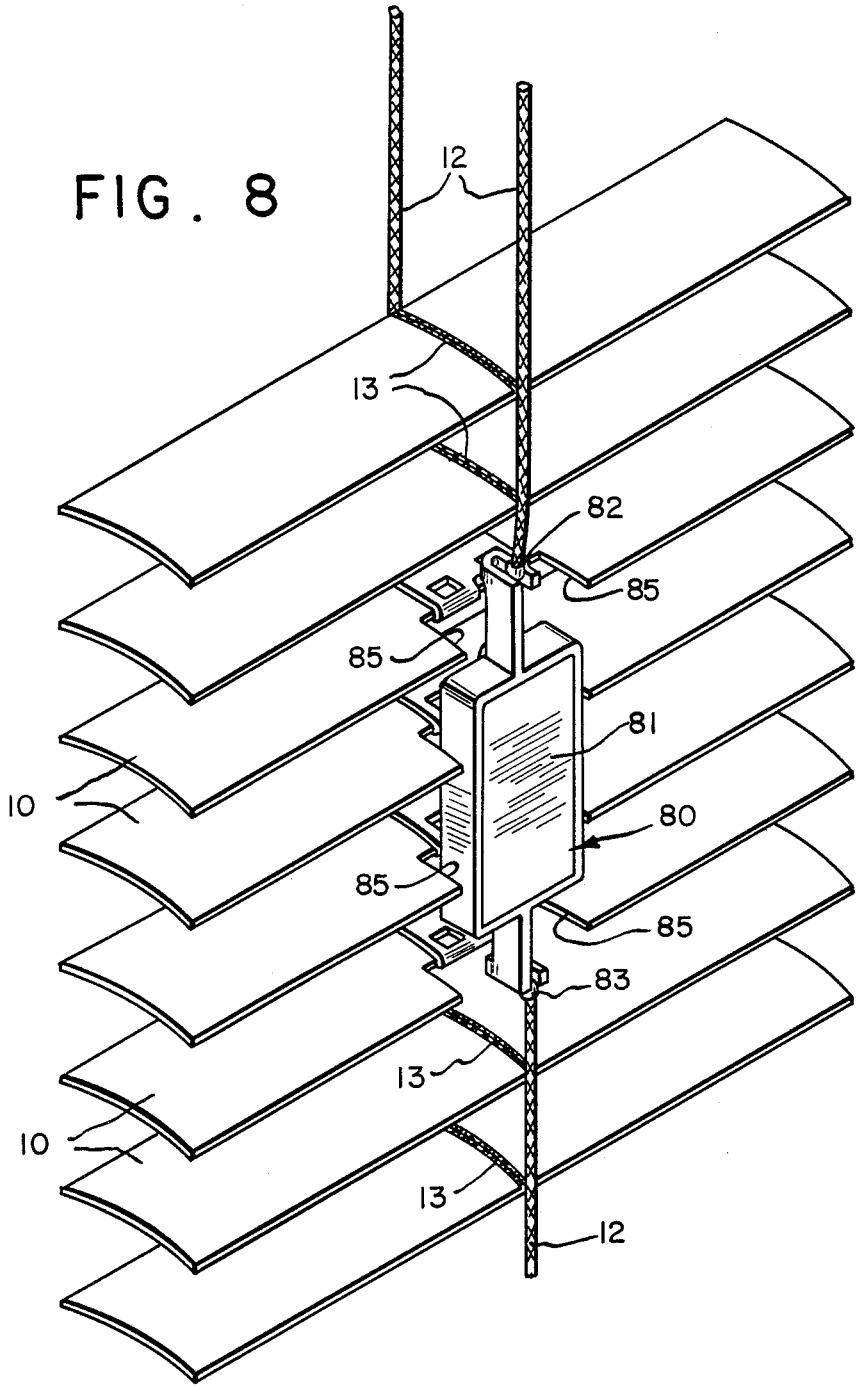
FIG. 8 is a perspective view of an operating element in the form of a modified housing enclosing magnets connected to a tape cable by way of a securing means.

Referring to FIG. 8 the operating member 80 comprises a housing 81 containing at least one magnet, not shown, connected to a tape cable 12 at two tie points 82 and 83 at either end of the housing with the cable extending back of the housing. Cutouts 85 are made in slats adjacent the housing and in the area of the slats next to the cable 12 in order to accommodate the housing at it moves vertically when moved by an operating member. In this manner, the spacing between glass panes may be kept at a minimum and closely approximate that of the slats in their fully open position.

Referring to FIGS. 9–12, there is illustrated a slat pad 90 for securely fixing a slat having a cutout between an upper and lower rung immediately adjacent an exterior tape cable positioned on the opposite side of a slat than an operating element such that the exterior edge of the slat, and thus the entire slat, is maintained in a proper vertical position as well as in a proper lateral position. To achieve this it is necessary that both the top and bottom rungs be held securely to the top and bottom surfaces of portions of the slat opposite a cutout. As shown the pad 90 has an upper surface 91 and two depending flanges 92 and 93 adapted to engage an inner edge 86 of the cutout and the rear edge 87 of a slat. The flange 93 has an inturned shoulder 94 adapted to engage an under surface of a slat while tabs 95, formed from lanced portions in the upper surface, are adapted to engage the underside of a slat adjacent the edge 86. The upper surface 91 has a slot 97 therein adapted to receive one tape cable 12 and the flange 92 and top surface have a notch 98 therein adapted to receive upper and lower portions of a rung. Notch 98 includes a hook pad 99 adapted to secure a bottom rung to the edge 86. The flange 92 in addition to securing the pad on a slat also serves as a bearing surface between a slat and the housing 81 of the operating element.

Figure 9:
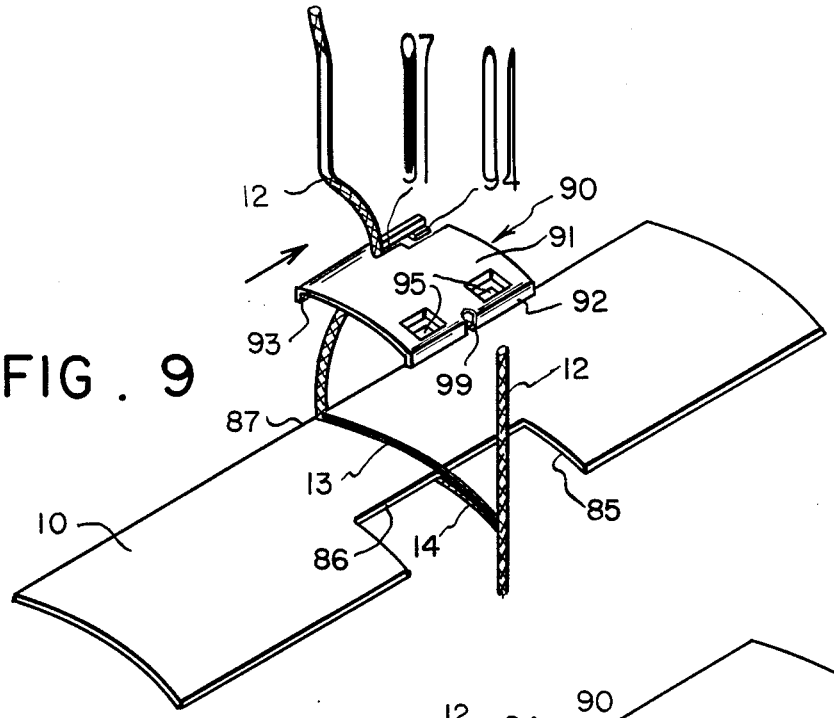
FIG. 9 is a view of a portion of a venetian blind slat illustrating attachment of a securing pad to a tape cable.
Figure 10:
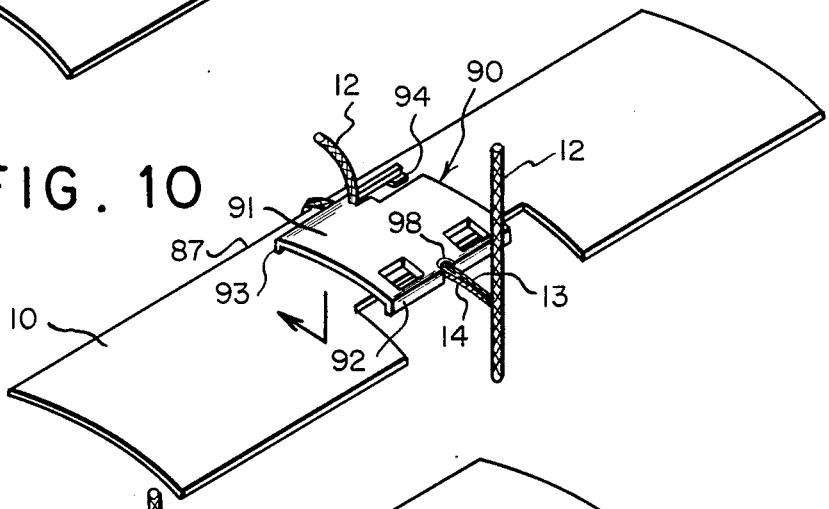
FIG. 10 is a view similar to FIG. 9 illustrating the manner of attachment of a pad to a slat.
Figure 11:
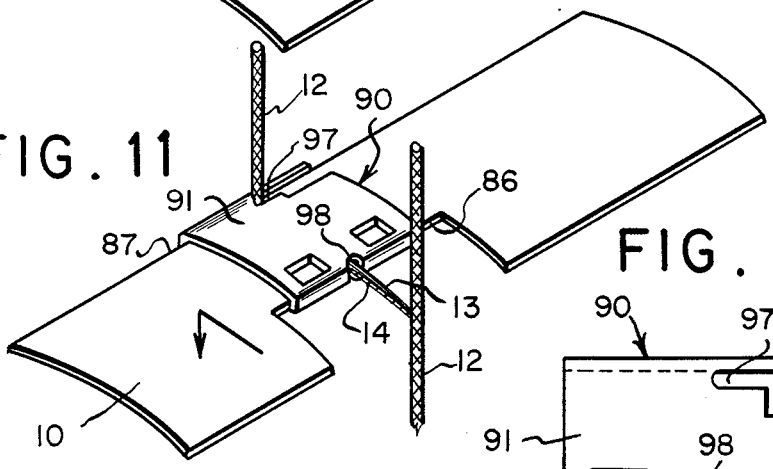
FIG. 11 is a view similar to FIG. 9 illustrating the attachment of a pad to a slat.
Figure 12:
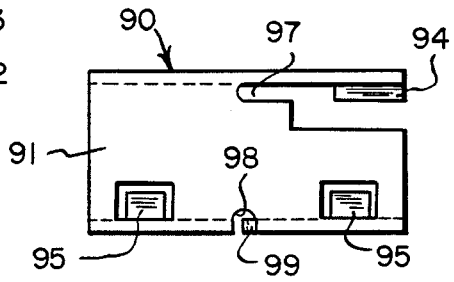
FIG. 12 is a plan view of the pad shown in FIG. 11.

The pad 90 is initially installed onto a slat as shown in FIG. 9 by threading a tape cable 12 into the slot 97. The upper and lower rungs are then placed into notch 98 and the tabs 95 applied to the underside of the slat adjacent the edge 86 of the cutout. The portion of flange 93 bearing shoulder 94 is then forced outward allowing the shoulder to slip beneath the edge 87 after which it is allowed to snap into place as shown in FIG. 11.

Figure 13:
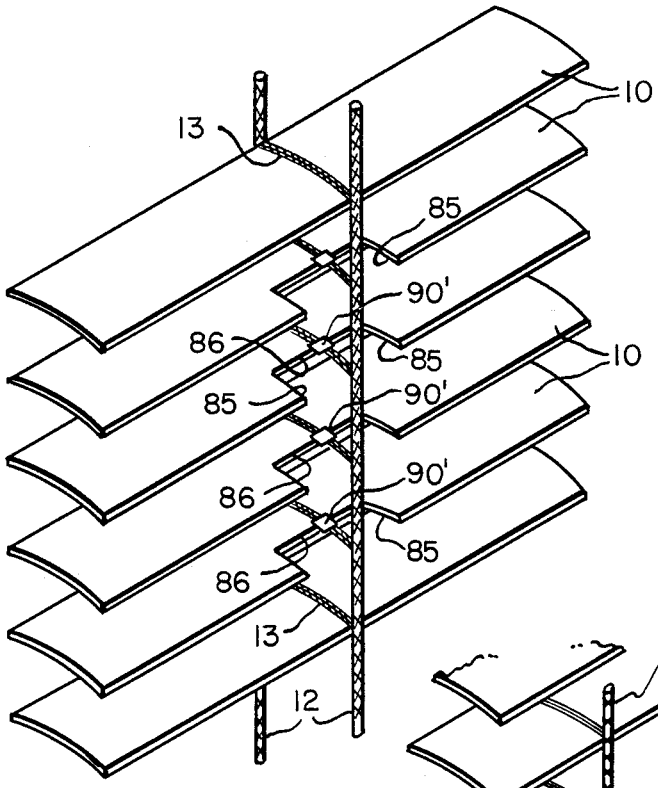
FIG. 13 is a perspective view similar to FIG. 8 having a modified pad for securing a slat to a tape ladder.

A simplified form of pad is shown in FIG. 13 which comprises a clip 90' which may be affixed to the top and bottom surfaces of the slat adjacent the edge 86 of the cutout by an adhesive. As shown the clip 90' will hold an upper rung securely to the top of the slat and a bottom rung to the bottom of the slat thus fixing the slat with respect to the cable.

Figure 14:
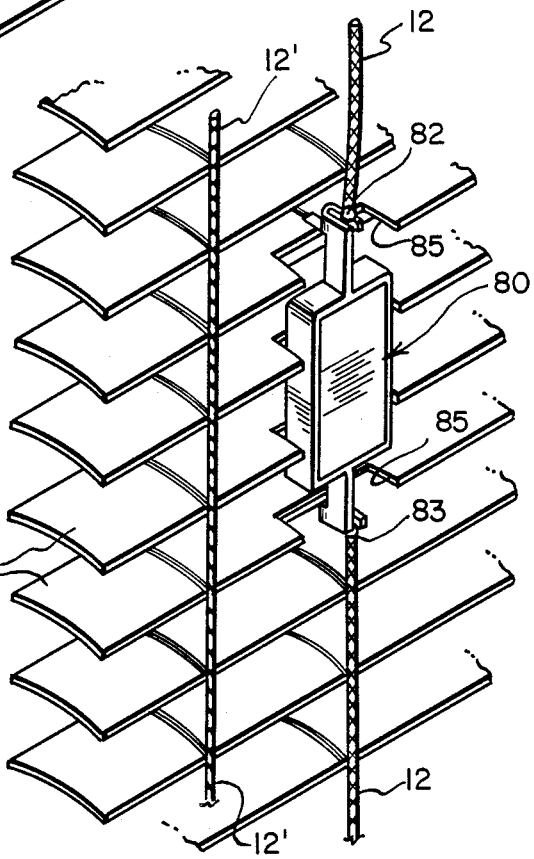
FIG. 14 is a view similar to FIG. 8 having a further tape ladder for securing slats.

In FIG. 14 an arrangement is shown for assuring proper vertical alignment of slats having cutouts without the use of pads connecting the slats to the cable 12. As shown, a further or auxiliary ladder 12' connects slats having cutouts to one or more solid slats extending both above and below the slats having the cutouts such that the auxiliary ladder maintains proper spacing.

Figure 15:
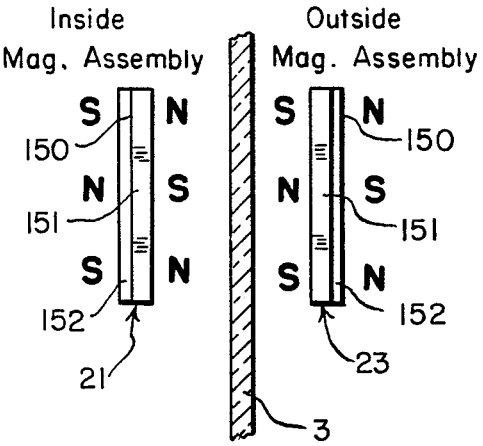
FIG. 15 is a diagrammatic view of the placement of magnets in the operating element and operating member according to the invention.

FIG. 15 discloses diagrammatically the arrangement of magnetic means in each of the operating elements 21 and operating member 22. As shown a plurality of magnets 150, 151 and 152 are positioned in a single group in each of the operating element and member such that adjacent magnets have opposite polarity. The group of magnets of the operating element is then positioned opposite the group of mangets of the operating member so that polarities between the two groups are opposed. I have found that this particular arrangement of magnets provides a strong magnetic coupling between the operating member and the operating element.

In addition to the arrangement of magnets shown in FIG. 15, other arrangements could be utilized. For example, a single pole magnet could be included in the operating element and a pole piece in the operating member, as well as other combinations of magnets and pole pieces.

Figure 16:
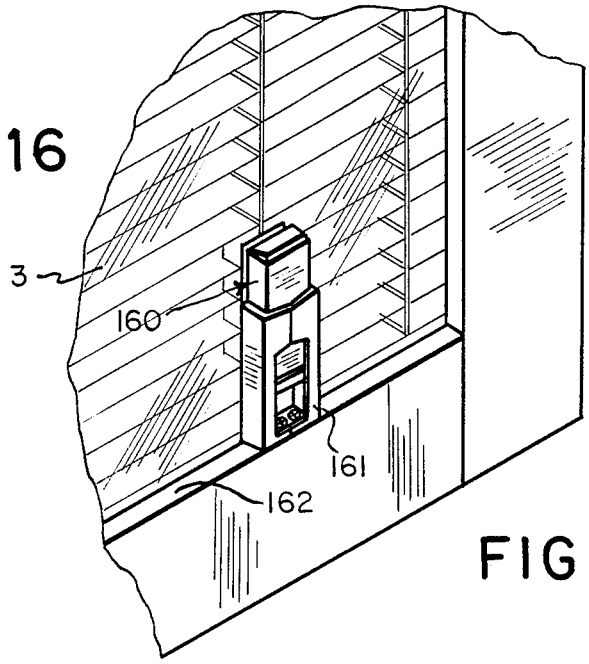
FIG. 16 is a perspective view of a portion of a window unit with the operating member enclosed in a slide.
Figure 18:
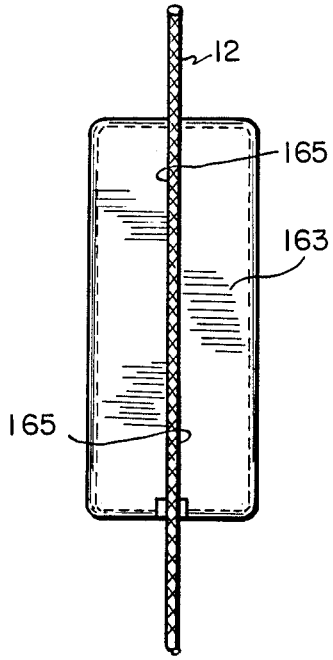
FIG. 18 is an enlarged rear view of an operating element according to the invention.
Figure 17:
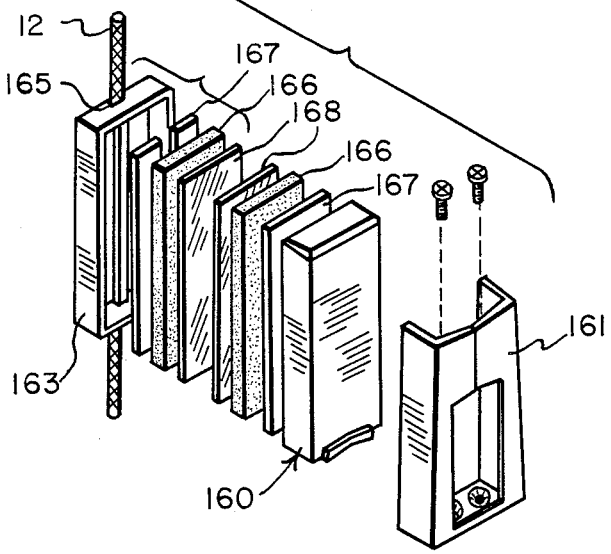
FIG. 17 is an exploded view of an operating element and operating member constructed according to the invention.

A preferred form of housing for the magnets of the operating element and operating member is illustrated in FIGS. 16–17. As shown, the housing 160 of the exterior operating member is slidable in a slide 161 fixed to a bottom windowsill 162 or other portion of the window unit. The housing 163 of the inner operating element has a tapered groove 165 on its rear outer surface into which a tape cable is wedged. If desired, the cable may be further affixed to the housing by welding or by use of an adhesive. Both housings 160 and 163 each contain a magnetic means which may comprise a magnet 166 having a plurality of oppositely disposed poles in the manner illustrated in FIG. 15. A keeper 167 is positioned between the magnet and the housing while a layer of teflon film 168 is affixed to the outer face of the magnets in order to contact a pane of glass and reduce friction forces between the glass and the movable operating element and member.

Figure 19:
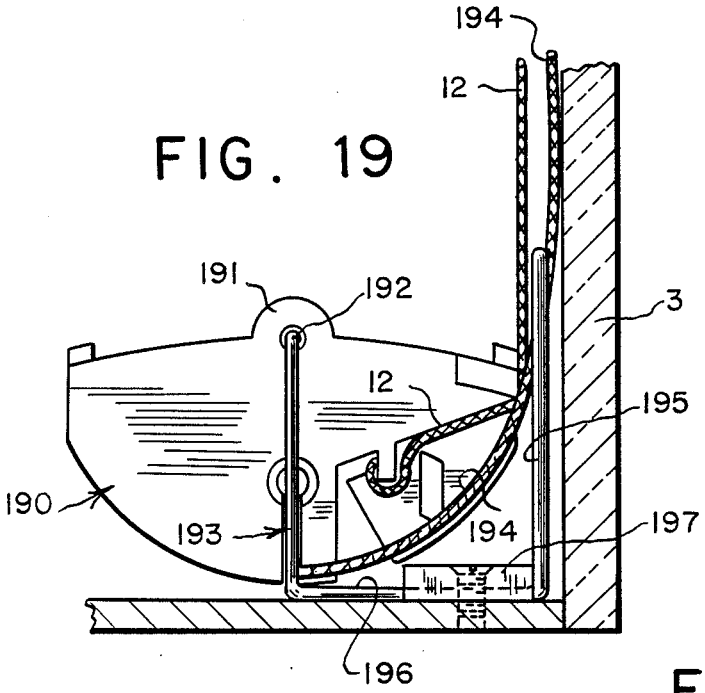
FIG. 19 is a side sectional view of a separate drive cable connected to a tape stabilizing element utilizing a guide arm; and, FIG. 20 is a perspective view of the guide arm illustrated in FIG. 19.
Figure 20:
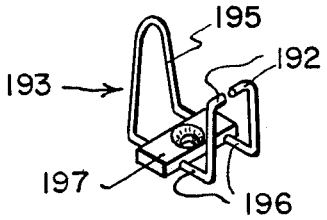

In the tilting transfer mechanisms described with reference to FIGS. 1–15, the connecting means operatively connecting the operating element to the tape stabilization elements includes a tape drive cable. In some installations, particularly those having wide slats, it may be preferable that the connecting means operatively connecting the operating element to the tape stabilization elements be by way of a separate drive cable extending from the operating element to the stabilization elements. Such an arrangement is illustrated in FIG. 19 where a lower stabilization element 190 is shown supported by a pivotal bearing element 191 rotatably supported on the ends 192 of a wire hanger 193. Tape cables 12, only one of which is shown, are mounted to the stabilization element in the usual manner. A separate drive cable 194 is connected to the lower tape stabilization element 190 and extends to an operating element which may be similar to either of the ones shown in FIGS. 2–8 and 18, and then onto an upper stabilizing element, not shown, similar to the lower element 190. Preferably the opposite side of stabilization element 190 is also connected by the drive cable 194 to the upper stabilization element and the drive cable is longitudinally in line with the bearing element 191. As shown in FIG. 19, if the stabilization element 190 were pivoted, the right radial edge of the element would move laterally to the left and the drive cable would be subjected to lateral forces in the same manner as described previously with respect to the tape cables. In order to prevent this, and to maintain cable tension in the cable on the low force side of the operating element (side of the element in the direction of linear movement) substantially constant, I provide a guide arm 195 which guides the drive cable 194 next to the pane 3.

As shown the hanger 193 is substantially saddle-shaped having spaced vertical upstanding arms forming the guide arm 195 and the support or hanger for the bearing element 191. The bottom horizontal portion 196 of the hanger may be fixed to a windowsill by a clamp 197.

While I have shown and described the tilting transfer mechanisms of the invention as used with window units having two panes, the mechanisms could be used equally as well with units having a single pane of glass or with units having three or more panes of glass, the only requirement being that the operating member be accessible for control purposes from the interior of a building. The transfer mechanism using a magnetic coupling for operatively connecting the operating element with the operating member is particularly adaptable for use with hermetically sealed units since there are no moving operating parts subject to wear which could result in loss of a seal between the parts.

The tilting transfer mechanisms described are further adaptable for use in reversible blind assemblies since there is basically no difference between top and bottom portions of the tilting transfer mechanisms and blind assembly. Further since the blind assembly may be reversible, any pre-assembled window unit in which the blind assembly is installed would likewise be reversible between top and bottom thus facilitating placement in a building structure.

I claim:

1. A tilting transfer mechanism for a venetian blind assembly having a plurality of slats, at least one tape cable forming part of a supporting means supporting said slats, pivotal upper and lower stabilizing elements supporting each said tape cable, and a bearing element pivotally supporting each said stabilizing element, characterized in that said tilting transfer means includes a linearly movable operating element, and connecting means operatively connecting said linearly movable operating element with said stabilizing elements whereby linear movement of said operating element will cause said stabilizing elements to pivot about said pivot bearings to tilt said slats.

2. A tilting transfer mechanism according to claim 1 further characterized in that said tape cable forms part of said connecting means.

3. A tilting transfer mechanism according to claim 1 further characterized in that a tape cable forms a part of said connecting means and wherein said connecting means includes in addition flexible or pivotally mounted rigid linear elements connecting said operating element with a tape cable.

4. A tilting transfer mechanism according to claim 3 further characterized in that said flexible linear elements are connected to the tape cable and the operating element at such points that they cross in a vertical plane.

5. A tilting transfer mechanism according to claim 1 further characterized in that said operating element has a guide means extending in a direction transverse to the direction of linear movement of the operating element and in that said connecting means includes a slidable element slidable in said guide means whereby said connecting means may move in a direction transverse to the linear movement of the operating element during operation of the tilting transfer mechanism.

6. A tilting transfer mechanism according to claim 1 further characterized in that said blind assembly forms part of a window unit including a pane, in that said operating element is slidable in a linear direction on one side of said pane, and in having an operating member linearly slidable on the opposite side of said pane from said operating element and coupled with said operating element.

7. A tilting transfer mechanism according to claim 6 further characterized in that said operating element is magnetically coupled with said operating member.

8. A tilting transfer mechanism according to claim 7 further characterized in that said operating element and operating member each include at least one magnet therein.

9. A tilting transfer mechanism according to claim 8 further characterized in that each of said operating element and said operating member includes a plurality of magnets.

10. A tilting transfer mechanism according to claim 6 further characterized in that said pane forms part of a window unit having a plurality of panes and wherein said operating member is accessible from the interior of a building in which the unit is to be mounted.

11. A tilting transfer mechanism according to claim 6 further characterized in that said pane forms part of a hermetically sealed window unit with said venetian blind assembly being positioned within said unit.

12. A tilting transfer mechanism according to claim 7 further characterized in that said operating element includes an inner housing containing at least one magnet with said inner housing being connected to said connecting means and wherein said operating member includes an outer housing containing at least one magnet.

13. A tilting transfer mechanism according to claim 12 further characterized in that some of said slats over at least the area of linear movement of the operating element have cutouts therein to receive a part of said operating element with the remainder of the slats comprising solid slats.

14. A tilting transfer mechanism according to claim 13 further characterized in that said operating element is connected to said tape cable, said tape cable forming part of a tape ladder that has a plurality of upper and lower rungs which support said slats.

15. A tilting transfer mechanism according to claim 12 further characterized in having a guide adapted to be fixed to the window unit and in which said outer housing may slide.

16. A tilting transfer mechanism according to claim 6 further characterized in that said operating element includes an inner housing having a back wall with a tapered slot therein receiving and fixing a part of the connecting means.

17. A tilting transfer mechanism according to claim 6 further characterized in that said operating element includes an inner housing having tie points on the top and bottom sides thereof connecting said housing to a part of the connecting means.

18. A tilting transfer mechanism according to claim 1 further characterized in that said connecting means comprises in part a separate drive cable connected to said upper and lower tape stabilizing elements and to said linearly movable operating element.

19. A tilting transfer mechanism according to claim 18 further characterized in that a portion of the drive cable engages a surface of a stabilizing element spaced from the pivot axis of the element and including in addition a drive cable guide for guiding the drive cable near the stabilizing element to maintain constant tension in the complete drive cable including the portion of the drive cable on the side of the operating element in the direction of linear movement of the operating element.

20. A tilting transfer mechanism according to claim 18 wherein said guide comprises a saddle-shaped wire hanger having two spaced parallel upstanding portions with one of said portions forming a guide arm and the other of said portions forming a bearing support for one of said pivotal stabilizing elements.

21. A tilting transfer mechanism according to claim 14 further characterized in having pad means associated with some of said slats having a cutout for holding an upper and lower rung to the top and bottom surface of a slat adjacent a cutout.

22. An operating mechanism for a venetian blind assembly positioned adjacent one side of a window pane including a lineraly movable operating element on the same side of the pane as the venetian blind assembly and a linearly movable operating member on the opposite side of the pane magnetically coupled to the operating element, characterized in that each of said operating element and said operating member includes a housing, a magnet in the housing having a plurality of north and southpoles, and a pole piece positioned between the housing and the magnet serving as a magnetic keeper joining north and south poles of the same magnet, and in that the poles of one polarity of the magnet associated with the operating element are positioned opposite the poles of opposite polarity of the magnet associated with the operating member.

23. An operating mechanism according to claim 22 further characterized in that a thin sheet of magnetically pervious lubricating material is positioned between the magnet and the pane in each of said operating element and said operating member.

* * * * *